United States Patent [19]

Landreau

[11] 4,005,834

[45] Feb. 1, 1977

[54] WINDING CABLES AND THE LIKE ON TO STORAGE DRUMS

[75] Inventor: Jean Florent Francois Marcel Robert Landreau, Auzay, France

[73] Assignee: Societe Anonyme Française du Ferodo, Paris, France

[22] Filed: June 9, 1975

[21] Appl. No.: 584,856

[30] Foreign Application Priority Data

June 11, 1974 France ..... 74.20111
Oct. 28, 1974 France ..... 74.36031

[52] U.S. Cl. ..... 242/158.3
[51] Int. Cl.[2] ..... B65H 57/28
[58] Field of Search ..... 242/158.2, 158.3

[56] References Cited

UNITED STATES PATENTS

| | | | |
|---|---|---|---|
| 1,551,251 | 8/1925 | Hopkins | 242/158.3 |
| 1,797,331 | 3/1931 | Dale | 242/158.3 |
| 3,533,575 | 10/1970 | Laky | 242/158.3 |

FOREIGN PATENTS OR APPLICATIONS

| | | | |
|---|---|---|---|
| 13,766 | 1962 | Japan | 242/158.2 |

OTHER PUBLICATIONS

IBM Technical Disclosure Bulletin; Intermittent Norm Drive; Sept. 1963, p. 14.

*Primary Examiner*—Richard C. Queisser
*Assistant Examiner*—Charles Gorenstein
*Attorney, Agent, or Firm*—A. W. Breiner; A. W. Breiner

[57] ABSTRACT

Device for winding a cable on a drum in such manner as to form turns each comprising a circular portion extending over the major part of its circumference and connected to an adjacent turn by a short oblique portion, wherein the cable in the course of winding is guided by a cable guide member, means being provided to displace this member step-by-step along the drum in rotation, in such manner as to keep it stationary during the major part of each revolution of the drum and to displace it by one step over a distance equal to the diameter of the cable while the drum is completing its revolution.

8 Claims, 12 Drawing Figures

WINDING CABLES AND THE LIKE ON TO STORAGE DRUMS

BACKGROUND OF THE INVENTION

This invention relates to cables and other elongated and pliable elements such as electric conductors and flexible pipes, which will hereinafter be called cables, and concerns their winding on to drums such as the drums of winches, winders or storage drums. It applies especially to winches for dredging, towing, hoisting, hauling, drilling and oceanographic winches, but can also apply to pliable pipes serving for the supply of oil under pressure to hydraulic devices for marine petroleum drilling, and for example to the coaxial cables of suspended submarine television cameras or to pipes for supplying public works tools from a hydraulic power centre.

In conventional winding systems the adjacent turns of each cable layer wound on a drum are not exactly contiguous, so that the turns of successive layers tend to insert themselves into the intervals existing between the turns of the immediately subjacent layers. This can result in jamming prejudicial to the durability of the cables. In particular in installations working at sea, cables of very great length, for example 1,000 metres, and thus of very high price are currently in use. When the cable is subjected to slight forces at low speeds or has to carry out an operation without particular constraint, it is strictly possible to wind the cable on to a drum without taking special precautions, and the operation is convenient. On the other hand for greater forces, that is when the cable has for example to carry out a hoisiting or hauling function or to support a tool in addition to its own weight when the cable is wound, the cable turns of the successive layers tend to insert themselves into the intervals existing between the turns of the layers immediately subjacent to them. This results in cable jamming which can be irreversible and necessitate the freeing of the cable by cutting with a blow torch in the jammed zone or can at least lead to a deterioration of the cable in the long term by successive jamming. This risk also exists for cables subjected to slight forces but the high cost of which necessitates perfect winding; this is the case especially with the winding of coaxial cables of suspended submarine television cameras.

SUMMARY OF THE INVENTION

The present invention aims to avoid these drawbacks by ensuring an orderly setting of the cable on the drum in such manner that the turns remain perfectly contiguous over all the layers of the winding.

To this end the cable is wound on the drum in such manner that each turn comprises a circular portion extending over the major part of its circumference and connected to an adjacent turn by a short oblique portion, and according to the invention the cable in the course of winding is guided by a member which moves step by step along the drum in rotation and the movement of which is controlled in such manner that the cable guide member remains stationary during the major part of each revolution of the drum and moves over a distance equal to the diameter of the cable while the drum is completing its revolution.

The cable guide member can be displaced in accordance with a pre-established program, or be controlled in position by a feeler element which follows a guide track, for example a groove, traced on a cylinder rotating at a speed proportional to that of the drum.

In one embodiment of the circular portions of the turns forming the two ends of each layer of the winding are placed respectively against the adjacent side members of the drum, by reason of the fact that for the winding of the last turn of each layer the cable guide member remains stationary for a supplementary revolution before moving by one step in the direction taking it away from the side member adjacent to this last turn. This can be realised by causing the grooved cyliner which rotates in synchronism with the drum to rotate at a speed reduced in the ratio 1 : 2.

In this embodiment each turn of the successive layers must rest on an immediately subjacent turn. In another embodiment, to prevent the risk that a turn in the course of winding may slip or roll on the subjacent turn and drop into the groove formed between the latter and the adjacent turn, the turns of the successive layers are caused to rest in the grooves formed by the immediately subjacent layer. To this end the spacing between the two side members of the drum is equal to an odd number of cable half diameters, and an end turn of the first layer is supported by an abutment element at a distance from the adjacent side member equal to a half diameter of the cable.

The abutment member is for example interposed between the first turn and the adjacent side member. The cable portion wound directly on to the drum thus forms a first layer of contiguous turns between this abutment and the other side member. The turns of the second layer rest in the grooves included either between the turns of the first layer or between the first of these turns and the adjacent side member, and so on. For the winding of the last turn of this layer the cable guide member will remain stationary only during the major part of one single revolution of the drum and then will move by a half step in the direction away from the side member adjacent to this last turn. In the case where the cable guide member is controlled in position by a feeler following a guide track traced on a rotating cylinder, this cylinder can rotate at the same speed as the drum.

BRIEF DESCRIPTION OF THE DRAWINGS

The invention will now be further described, by way of example, with reference to the accompanying drawings, in which.

DESCRIPTION OF THE PREFERRED EMBODIMENTS

Figure 2:
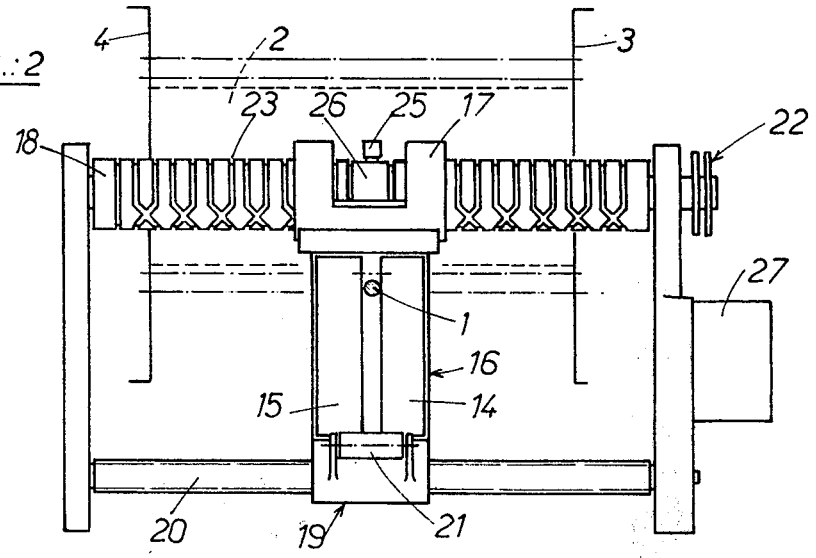
FIG. 2 is an elevation seen in the direction of the arrow II in FIG. 1.
Figure 1:
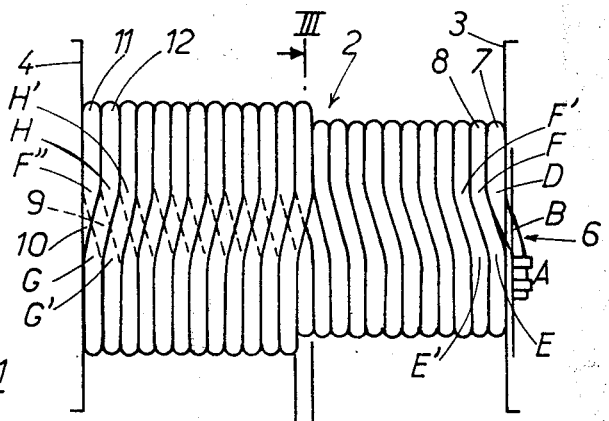
FIG. 1 is a plan view of an apparatus according to the invention.
Figure 4:
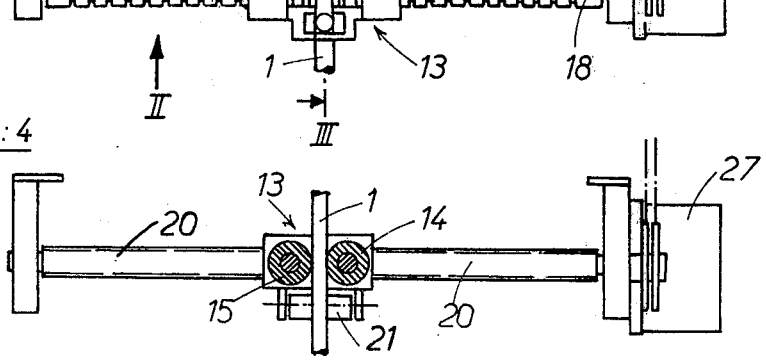
FIG. 4 is a sectional view along the IV—IV in FIG. 3.
Figure 3:
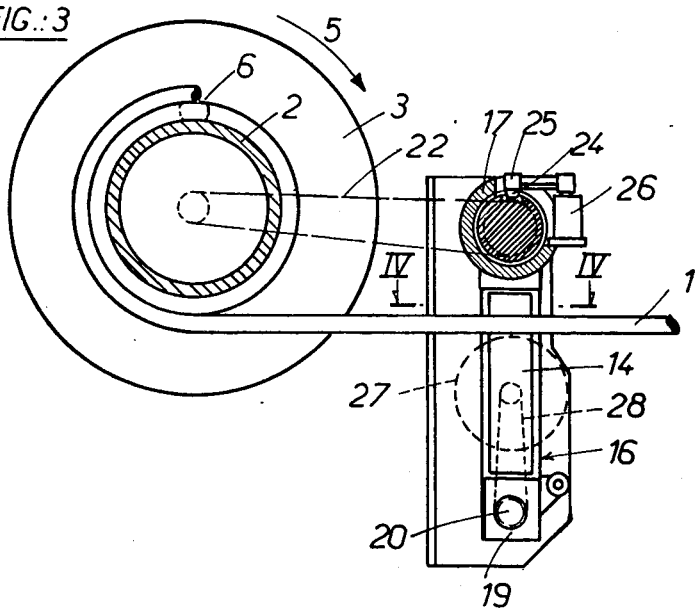
FIG. 3 is a sectional view along the line III—III in FIG. 1.

In FIGS. 1 to 3 there is seen a cable 1 in the course of winding on to a drum 2 equipped with two side members 3, 4 and driven in rotation in the direction of the arrow 5 by means not represented. In a well known manner the end of the cable 1 passes through a window 6 in the side member 3 and is fixed at A to the outer face of the latter.

Thus the cable arrives obliquely on to this drum. The cable is incurved at D and set in orderly manner against the inner face of the side member 3 so that the winding of the first turn 7 takes place against this side member during a little less than one revolution, between the point D and a point E situated opposite to the window 6. The oblique portion B D of the cable 1 (B being the point where the axis of the cable passes through the window 6) is thus followed by a circular portion D E of the first turn 7, this circular portion being placed in a plane parallel with the side members and perpendicular to the axis of rotation of the drum. At the point E the cable is diverted laterally to F towards the left in FIG. 1, by a step equal to its diameter, and then set orderly against the portion D E of the first turn 7, as far as E', where it is again diverted by a step equal to its diameter as far as F', and so forth.

The trajectory E F very substantially matches the trajectory B D and the gap between the portions B D and E F is very small and practically negligible. The first turn 7 comprises the circular portion D E which extends over the major part of its circumference and is connected by the short oblique portion E F to the second turn 8. The latter comprises the circular potion F E' which extends over the major part of its circumference and is connected to the subsequent turn by the short oblique portion E' F'. Each of the turns following the first turn comprises a circular portion set in orderly manner against the circular portion of the preceding turn, and an oblique portion set against the oblique portion of the preceding turn. Thus there is no gap between the turns in which the turns of the layer situated above can be jammed; nor are they in danger of jamming into the very narrow space existing between the potions B D ad E F.

The oblique portion of the penultimate turn 9 of the first layer terminates at F'' against the side member 4 and the last turn 10 is set over its entire circumference against this side member 4. This last turn 10 comprises a circular portion followed by a radially diverted portion which terminates above the point F''. As the drum continues to rotate the cable commences the first turn 11 of the second layer, which again comprises a circular portion set in orderly manner against the side member 4 and a portion G H diverted laterally by a step equal to the diameter of the cable, but this time towards the right in FIG. 1. This first turn 11 is followed by a second turn 12 comprising a circular portion H G' parallel with the side member 4 and an oblique portion G' H', and so forth, all the turns of the second layer being set in orderly manner against one another like those of the first layer.

The winding of the second layer continues as far as the side member 3, where the reversal procedure described above for the arrival of the cable in contact with the side member 4 is reproduced. The cable commences and continues the winding of a third layer towards the side member 4, and so forth. Thus as many layers as necessary may be wound, without any interval existing between the turns in which there is risk of jamming of the turns placed thereabove.

The winding as described above is realised with the aid of the device represented in FIGS. 1 to 5, which comprises essentially a cable guide member 13 and means for its step-by-step displacement along the drum 2 in synchronism with the rotation of the latter. The cable guide member 13 is constituted by a pair of vertical rollers 14, 15 mounted on a carriage 16 comprising a bearing 17 which can slide along a cylindrical shaft 18 parallel with the drum, and a nut 19 engaged on a threaded shaft 20 parallel with the shaft 18 and the drum 2. The distance between the vertical rollers 14, 15 is equal to the diameter of the cable 1 and the carriage 16 further supports a horizontal roller 21 at the level of the base of these vertical rollers.

The cylindrical shaft 18 is driven in rotation by a chain transmission 22 at a speed equal to half the speed of rotation of the drum 2. In the periphery of this cylindrical shaft 18 a groove 23 is cut in which there is engaged a feeler 24 which controls the position of the carriage 16 by means which will be described hereinafter. In view of the fact that the cylindrical shaft 18 rotates at half the speed of the drum 2, the groove 23 defines the path which the cable 1 must follow to effect the winding as described above and represented in FIG. 1. To this end, as shown by the developed view in FIG. 5, the groove comprises, starting from the point D of origin of the first turn 7, a section $D_1E_1$ of circular arc form which extends over a little less than half a circle and corresponds to the portion D E of the first turn, an oblique section $E_1$ $F_1$ corresponding to the short portion E F of this first turn, a second section $F_1E'_1$ of circular arc form and a second oblique section $E'_1F'_1$ corresponding to the second turn 8, and so forth.

Figure 5:
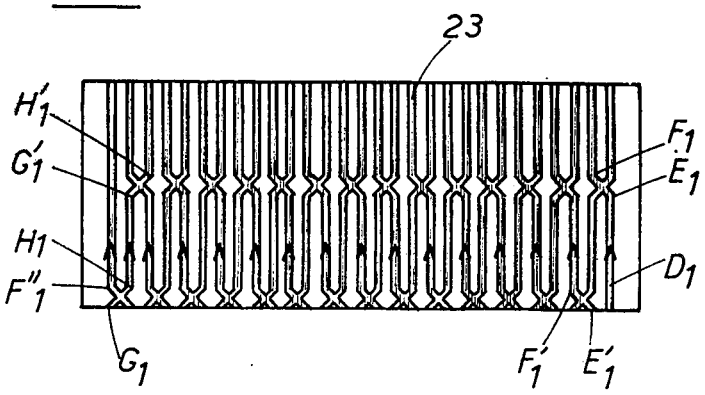
FIG. 5 is a developed view of the cylinder carrying the track for guiding the feeler which controls the cable guide member.

To the point F'' of the penultimate turn 9 of the first layer there corresponds a point $F''_1$ forming the extremity of a last section diverted to the left in FIG. 5. From this point $F''_1$ there starts a groove section $F''_1G_1$ which extends over a little less than the circumference of the cylindrical shaft 18 and corresponds to the turns 10 and 11. The section $G_1H_1$ is diverted to the right in the figure and corresponds to the portion G H of the turn 11, the sections $H_1G'_1$ and $G'_1H'_1$ correspond to the turn 12, and so forth. To the last turn of the second layer and to the first turn of the third layer, which must be set in order against the side member 3, there corresponds a circular section of the groove extending over a little less than the circumference of the shaft 18 and terminating at the point $E_1$.

In the form of embodiment as represented the feeler 24 is the feeler of the reading head 25 of a power operated reader 26. In the form of embodiment as represented the reader 26 is a hydraulic reader which effects the control the carriage 16 through the intermediary of a hydraulic motor 27 and the threaded shaft 20. The hydraulic reader 26 is of a well known type used currently in reproduction apparatuses with which machine tools are equipped, for example as shown in U.S. Pat. No. 2,580,686 to Edward M. May dated Jan. 1, 1952. For this reason it does not appear necessary to describe it in detail. The hydraulic reader 26 and its reading head 25 are supported by the carriage 16. The reader actuates a distributor (not shown) which controls the hydraulic energy supplied to the motor 27 by a pump (not shown). The motor 27 drives the threaded shaft 20 in rotation through a chain transmission 28. The nut 19 is immobilised in rotation in the carriage 16 so that the rotation of the threaded shaft 20 cause a translation movement of the carriage parallel with this threaded shaft and the drum.

When the feeler 24 travels a circular section such as $D_1$ $E_1$ or $H_1$ $G'_1$ of the groove 23, the reading head 26 keeps the distributor (not shown) closed controlling the supply of the motor 27. Thus the carriage 16 remains stationary so that the cable 1 winds on to the drum 2 over a circular turn portion such as D E or H G'. When the feeler 24 travels an oblique section such as $E_1$ $F_1$ or $G_1$ $H_1$ the reading head 26 controls the distributor (not shown) so as to feed the motor 27 so that the latter may rotate in the direction, at the speed and for the time required to advance the carriage 16 by a step corresponding to an oblique turn portion, such as E F or G H. During the stopping periods of the carriage, that is to say when the reading head 6 keeps the distributor closed, the pump (not shown) charges a hydraulic accumulator (not shown); the latter liberates the hydraulic fluid which it contains during the active periods of the carriage, that is to say when the carriage is advancing by one step.

Figure 7:
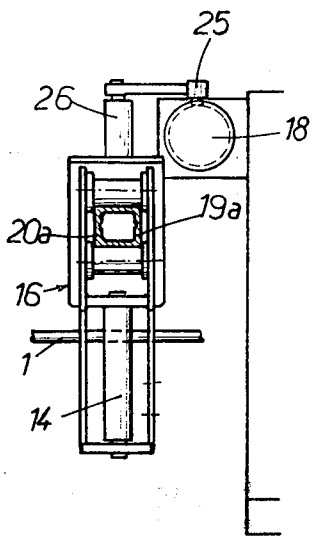
FIGS. 6 and 7 are views analogous respectively to FIGS. 2 and 3, showing aother embodiment.
Figure 6:
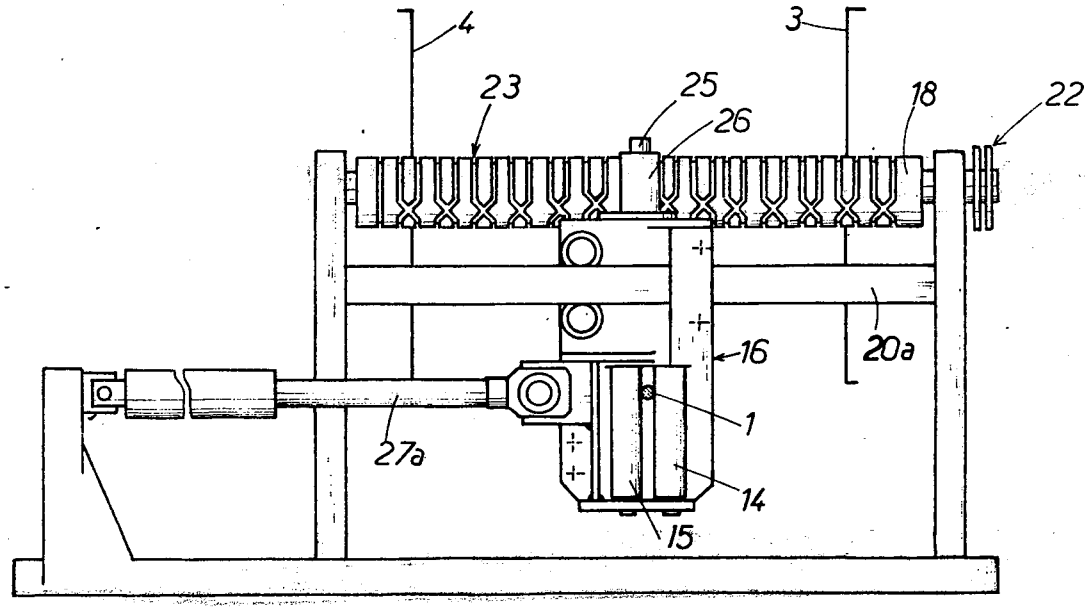

FIGS. 6 and 7, in which the elements play the same part as in the previous figures are designated by the same referenes, shown an embodiment which differs from the preceding only by the device for controlling the movement of the carriage 16. The threaded shaft 20 and the nut 19 of the preceding figures are replaced by a slideway **20*a* on which there slides a bearing 19*a* of the carriage and by double-acting jack 27*a* supplied directly by the distributor (not shown) which is controlled by the reading head 26. The hydraulic motor 27 is eliminated. The device operates in the manner already described, the reading head 26 controlling the step-by-step movements of the carriage 16 through the intermediary of the jack 27*a*, instead of controlling them through the intermediary of the motor 27 and the threaded shaft 20.**

In the embodiment according to FIGS. 8 to 12 the elements playing the same part as in the preceding figures are designated by the same reference numerals, increased by 100 units.

Figure 8:
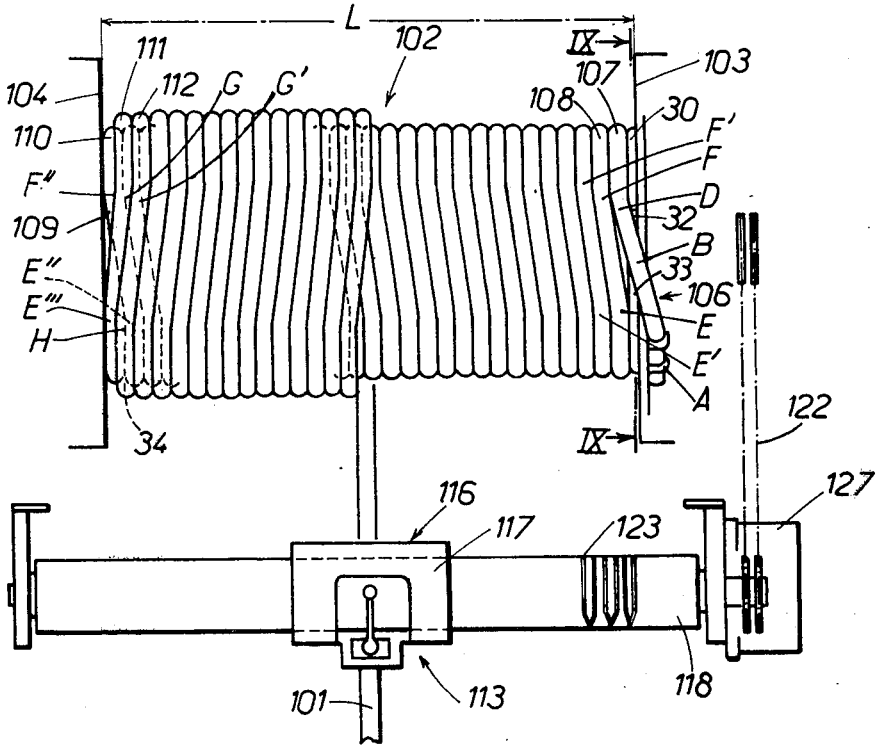
FIG. 8 is a plan view of a cable in the course of winding on to an apparatus according to another embodiment of the invention.

In FIG. 8 there is seen the cable 101 in the course of winding on the drum 102 equipped with the two side members 103 and 104 and driven in rotation by means not shown. As in the preceding figures the cable 101 passes into the window 106 through the side member 103; it is fixed at A to the outer face of the latter, arrives obliquely on the drum 102, is incurved at D and winds on to the drum in a first turn 107 during a little less than one revolution. However instead of being set in order immediately against the side member 103, the first turn 107 is here set in order against a packing piece 30.

Figure 9:
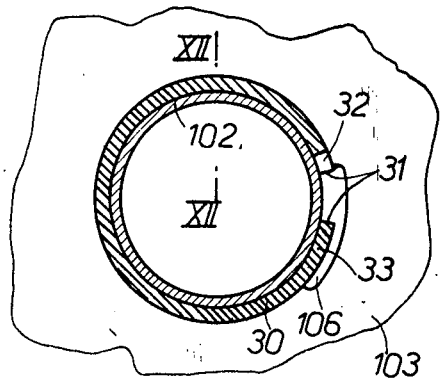
FIG. 9 is a sectional view along the line IX—IX in FIG. 8, the cable being assumed to be removed.
Figure 12:
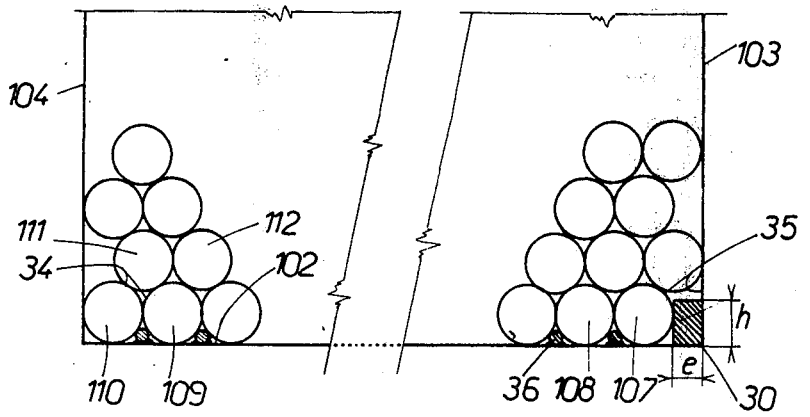
FIG. 12 is a partial longitudinal half-sectional view on a larger scale along the line XII—XII in FIG. 9, showing the drum on to which several layers of turns are wound.

As may be seen from FIGS. 8, 9 and 12, the packing piece 30 has a thickness e equal to half the diameter of the cable 101 and a height *h* between 65 and 75% of this diameter, and has the form of a ring interrupted at 31 and engaged on the drum 102 against the side member 103. The edges of the interruption 31 are cut on the slant at 32 and 33, starting from the window 106, so as to serve as supports for the portion B D of the cable 101 (B being the point where the axis of the cable passes through the window 106).

As in the preceding figures, the winding of the first turn 107 thus takes place, over a little less than one revolution, between the point D and a point E situated opposite to the window 106. Thus the portion B D of the cable 101 is followed by a circular portion D E of the first turn 107, this circular portion being placed in a plane parallel with the side members and perpendicular to the axis of rotation of the drum. At the point E the cable is diverted laterally to F towards the left in FIG. 8, by a step equal to its diameter, then set in order against the portion D E of the first turn 107, as far as E', where it is again diverted by a step equal to its diameter as far as F', and so forth.

The length L of the drum 102 between the side members 103 and 104 is equal to an odd number of half diameters (61 half dimaters, or 30 diameters and a half in the form of embodiment as represented), so that the circular portion F'' E''' of the last turn 110 (the thirtieth) of the first layer is set in order against the side member 104, all the turns of this first layer being set in order against one another. Starting from the point E''', the end of the circular portion of the last turn 110, as the drum continues to rotate the cable describes a portion E''' G diverted laterally by a half step (that is half of the diameter of the cable) which passes over the oblique portion E'' F'' of the penultimate turn 109, then forms the circular portion G H of the first turn 111 of the second layer, which comes to rest in the circular groove 34 formed between the circular portions of the turns 109 and 110 of the first layer. The cable then describes the portion H G' diverted by one step to the right, them comes to rest in a groove formed between the subjacent circular portions of the turns of the first layer, as so forth.

The winding of the second layer continues as far as the side member 103, the circular portion of the last turn of the second layer coming to rest in the groove 35 formed between the side member and the turn 107 (see FIG. 12), that is to say above the packing piece 30, then the procedure for reverals as described above on the arrival of the cable into contact with the side member 104 is reproduced, the cable first forming a portion diverted by a half step to the left and continuing the winding of a third layer towards the side member 104 and so forth. Thus it is possible to wind as many layers of turns as necessary, without the existance of any interval between the contiguous turns where the turns placed thereabove might jam, and without the risk that the turns in the course of winding may drop outside the grooves such as 34 and 35.

Figure 10:
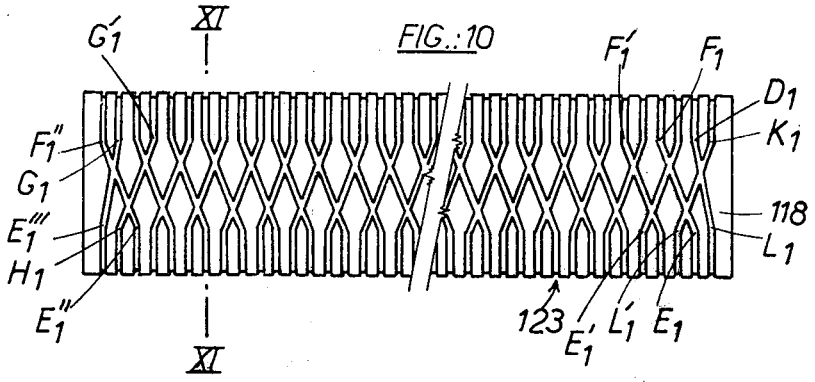
FIG. 10 is a partial enlarged elevation of the cylinder showing the track for guiding the feeler controlling the cable guide member.
Figure 11:
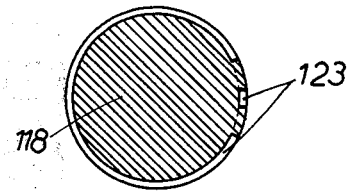
FIG. 11 is a sectional view along the line XI—XI in FIG. 10.

The winding as described above is carried out with the aid of the device as represented in FIGS. 8, 10 and 11, which differs from that described with reference to the preceding figures only in the design of the groove 123 and in the transmission ratio of the transmission system comprising the chain 122, which ratio is here 1 : 1 so that the cylindrical shaft 118 rotates at the same speed as the drum 102. It will be recalled only that the winding of the cable 101 on the drum 102 is guided by the cable guide member 113 supported by the carriage 116 which can slide parallel with the axis of the drum 102 and is controlled in position by a feeler engaged in the groove 123 cut in the cylindrical shaft 118.

The groove 123 defines the trajectory which the cable 101 must follow to effect the winding as described above and represented in FIGS. 8 and 12. To this end, as shown by FIGS. 10 and 11, in order to effect the winding from a point D (FIG. 8) of origin of the first turn 107, the groove 123 comprises a section $D_1$ $E_1$ of circular arc form which extends over a little less than the circumference of the shaft 118 and corresponds to the portion D E of the first turn, a section $E_1$ $F_1$ diverted by one step to the left which corresponds to the short portion E F of this first turn, a second section $F_1$ $E'_1$ of circular arc form and a second diverted section $E'_1$ $F'_1$ corresponding to the second turn 108, and so forth.

To the point F'' of the penultimate turn 109 of the first layer there corresponds a point $F''_1$ forming the end of a first section $E''_1$ $F''_1$ diverted to the left in FIG. 10. From this point $F''_1$ there starts a last groove section $F''_1$ $E'''_1$ which extends over a little less than the circumference of the cylindrical shaft 118 and corresponds to the circular portion F'' E''' of the last turn 110. The section $E'''_1$ $G_1$ is diverted by a half step to the right of the figure and corresponds to the portion E''' G of the turn 110, the section $G_1$ $H_1$ and $H_1$ $G'_1$ (diverted by one step to the right) correspond respectively to the circular portion G H and the oblique portion H G' of the turn 112, and so forth. The last section diverted by one step to the right $L'_1$ $K_1$ terminates at a half step further to the right than the point $D_1$ and is followed by a section $K_1$ $L_1$ of circular arc form which corresponds to the cicular portion of the last turn of the second row. From the point $L_1$ there starts a section $L_1$ $D_1$ diverted by a half step to the left which corresponds to the oblique portion of the last turn of the second row. This oblique section $L_1$ $D_1$ terminates in the section $D_1$ $E_1$ of circular arc form which ensures the winding of the circular portion of the first turn of the third row, thus recommencing the winding cycle.

In the case where the diameter of the cable is not absolutely constant over its entire length, the diameter which will serve to determine the distance between side members and the winding pitch will of course be the maximum diameter of the cable. In this case slipping of the turns of the first layer could occur, which would create spaces between certain of these turns where there would be risk of jamming of the turns of the second layer, and so forth. In order to avoid this risk the drum 102 is advantageously provided with guides of circular arc form interrupted in the zones where the turns are diverted and spaced by one step (equal to the maximum diameter of the cable), between which the circular portions of the turns of the first layer are placed. In the embodiment represented (FIG. 12) these guides are constituted by round iron lengths 36 curved into circular arcs and welded on to the drum 102.

Of course the embodiments described are only examples and they could be modified, especially by substitution of equivalent technical means, without thereby departing from the scope of the invention as defined in the claims. In particular the movement of the carriage could be obtained by a means other than a screw or a jack, for example by a step-by-step motor. The hydraulic reader could be replaced by a reader of another type, for example magnetic or photoelectric. The guide groove or track formed or traced on a rotating cylinder could be replaced by a programme device of another type. In the case of a small winch and a cable subjected to a slight force during its winding on to the drum, the movement of the carriage could be controlled directly by a cam, for example by the groove 23, the feeler 24 directly driving the carriage by travelling through this groove 23. Instead of interposing the abutment element according to FIGS. 8 to 12 between the first turn and the adjacent side member, it could be interposed between the last turn of the first row and the adjacent side member. In the latter case the abutment member could be an annular uninterrupted packing piece. The abutment member could be part of the adjacent side member.

What is claimed is:

1. A device for winding a cable onto a rotating drum, comprising a cable guide member, and control means comprising a cylinder having a guide track formed in the peripheral surface thereof, said guide track having portions of circular arc form connected by short oblique portions, means mounting the cylinder rotatably, means for rotating the cylinder at a speed proportional to the speed of rotation of the drum, a power operated reader having a reading head carrying a feeler engaging the guide track and compelled to follow the same, means for driving the cable guide member, and means for actuation of the driving means from the reading head.

2. A device accoding to claim 1, wherein the driving means comprises a nut fast with the cable guide member, a threaded shaft engaged in the nut and a motor to drive the threaded shaft in rotation.

3. A device according to claim 1, wherein the driving means comprises a jack.

4. A device for winding a cable onto a rotating drum between two side members of the drum, comprising a cable guide member and step-by-step displacement control means to keep the cable guide member stationary during a major part of a revolution of a drum in order that the cable may wind onto the drum forming a circular turn portion extending over a major part of the circumference of the drum, and to displace the cable guide member along the drum by a step having a length equal to the cable diameter during the remaining part of the revolution of the drum in order that the cable may form a short oblique turn portion on the drum, in which the control means comprise means to keep the cable guide member stationary during a supplementary revolution after the winding of the circular portion of the last turn of each layer, and to displace the cable guide member by one step in the direction away from the side member adjacent to the said last turn.

5. A device according to claim 4, wherein the control means comprise a cylinder, a guide track formed in the peripheral surface of the cylinder, means to rotate the cylinder at a speed equal to half the speed of rotation of the drum, a feeler compelled to follow the guide track, and means for the control of the position of the cable guide member by the feeler.

6. A device for winding a cable onto a rotating drum between two side members of the drum, the distance between said side members being equal to an odd number of half cable diameters, comprising a cable guide member, step-by-step displacement control means to keep the cable guide member stationary during a major part of a revolution of a drum in order that the cable may wind onto the drum forming a circular turn portion extending over a major part of the circumference of the drum, and to displace the cable guide member along the drum by a step having a length equal to the cable diameter during the remaining part of the revolution of the drum in order that the cable may form a short oblique turn portion on the drum, an abutment member to keep the circular portion of an end turn of the first layer at a distance from the adjacent side member equal to a half diameter of the cable, and means for displacing the cable guide member by a half step after the winding of the circular portion of the last turn of each layer.

7. A device according to claim 6 for the winding of a cable onto a drum having a window in the side member adjacent to the abutment member, wherein the abutment member is an interrupted ring having a thickness equal to a half diameter of the cable and the edges of the interruption are cut with a slant so as to serve as a support for the oblique portion of the cable included between the window and the circular portion of the turn adjacent to the said ring.

8. A device according to claim 6, wherein the control means comprise a cylinder, a guide track formed in the peripheral surface of the cylinder, means for rotating the cylinder at a speed equal to the speed of rotation of the drum, a feeler compelled to follow the guide track and means for controlling the position of the cable guide member by the feeler.

* * * * *